US005635965A

United States Patent [19]

Purwins et al.

[11] Patent Number: 5,635,965

[45] Date of Patent: Jun. 3, 1997

[54] WET CAPPING SYSTEM FOR INKJET PRINTHEADS

[75] Inventors: Thomas J. Purwins; William S. Osborne, both of Vancouver, Wash.

[73] Assignee: Hewlett-Packard Company, Palo Alto, Calif.

[21] Appl. No.: 384,290

[22] Filed: Jan. 31, 1995

[51] Int. Cl.[6] ..... B41J 2/165

[52] U.S. Cl. ..... 347/31; 347/32

[58] Field of Search ..... 347/29, 32, 33, 347/31

[56] References Cited

U.S. PATENT DOCUMENTS

| | | | |
|---|---|---|---|
| 4,543,589 | 9/1985 | Terasawa | 347/29 |
| 4,853,717 | 8/1989 | Harmon et al. | 347/30 |
| 5,027,134 | 6/1991 | Harmon et al. | 347/30 |
| 5,051,761 | 9/1991 | Fisher et al. | 347/33 |
| 5,055,856 | 10/1991 | Tomii et al. | 346/1.1 |
| 5,103,244 | 4/1992 | Gast et al. | 347/33 |
| 5,115,250 | 5/1992 | Harmon et al. | 347/32 |
| 5,146,243 | 9/1992 | English et al. | 347/29 |
| 5,151,715 | 9/1992 | Ward et al. | 347/140 R |
| 5,155,497 | 10/1992 | Martin et al. | 347/33 |
| 5,216,449 | 6/1993 | English | 346/140 R |
| 5,252,993 | 10/1993 | Tomii et al. | 346/140 R |
| 5,260,724 | 11/1993 | Tomii et al. | 346/140 R |
| 5,448,270 | 9/1995 | Osborne | 347/29 |
| 5,517,220 | 5/1996 | English | 347/29 |

FOREIGN PATENT DOCUMENTS

| | | | |
|---|---|---|---|
| 0552030 | 7/1993 | European Pat. Off. | B41J 2/165 |
| 590850A2 | 9/1993 | European Pat. Off. . | |
| 3528926 | 2/1987 | Germany . | |
| 59-045164 | 3/1984 | Japan . | |
| 59-209876 | 11/1984 | Japan | B41J 3/04 |
| 60-030348 | 2/1985 | Japan . | |
| 61-222748 | 10/1986 | Japan . | |
| 405162320 | 6/1993 | Japan | 347/33 |
| 60224550 | 11/1995 | Japan . | |

*Primary Examiner*—John E. Barlow, Jr.
*Attorney, Agent, or Firm*—Flory L. Martin

[57] ABSTRACT

A wet capping system is provided for inkjet printheads used in various inkjet printing mechanisms, such as printers, facsimile machines, scanners, plotters and the like. A wicking cap has an elastomeric body with an ink wicking area surrounded by a sealing lip to seal a region of the pen face surrounding the printhead nozzles. Optionally, the wicking area is lined with an elastomer or a compliant thin film, such as a sheet of mylar film, to define a wicking surface. The wicking surface draws ink from the pen through capillary action. While the pen is capped, the extracted ink dissolves any ink solids or residue accumulated around the nozzles. While useful with conventional dye based inks, this wet capping system is especially useful to remove the tough residue left on a printhead by pigment based inks.

28 Claims, 7 Drawing Sheets

FIG. 6
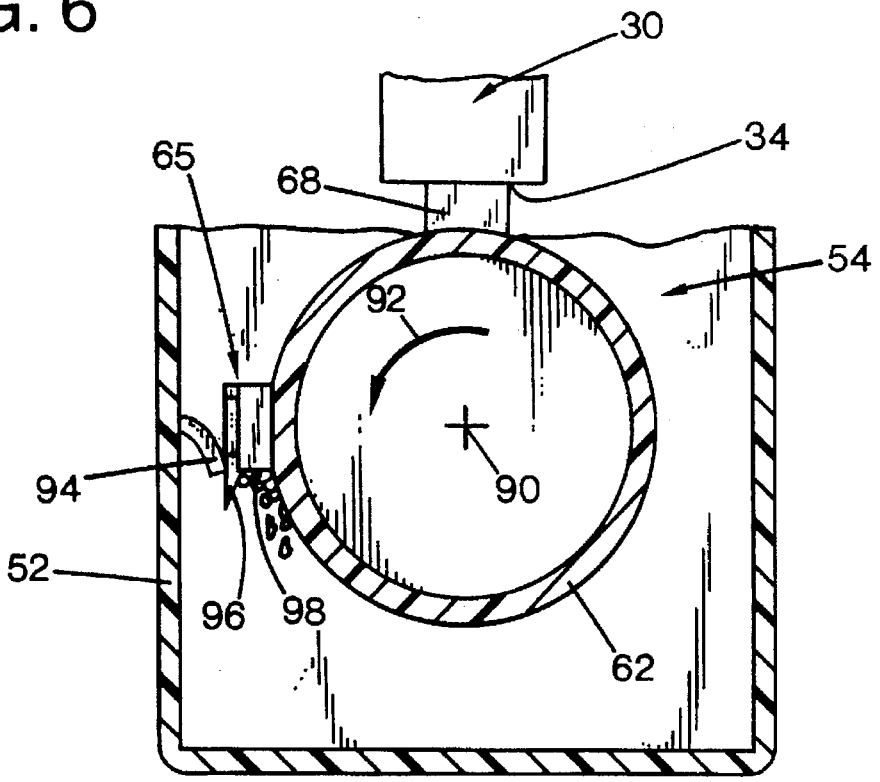
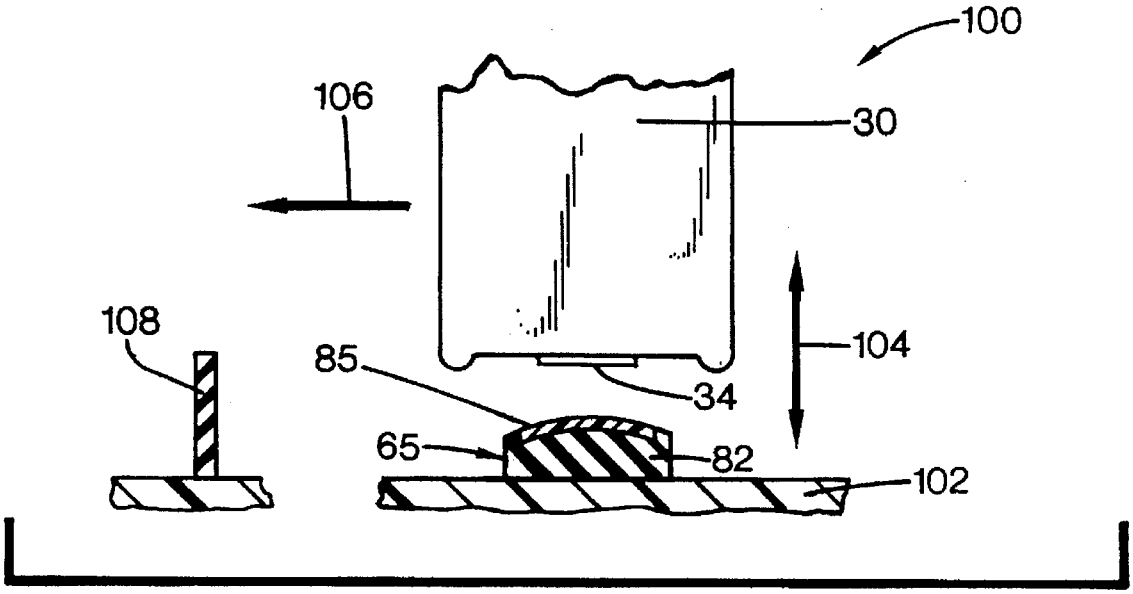
FIG. 7

WET CAPPING SYSTEM FOR INKJET PRINTHEADS

FIELD OF THE INVENTION

This invention relates generally to inkjet printing mechanisms, and more particularly to an apparatus and method for capping and protecting an inkjet printhead when not in use.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead moves back and forth across the page shooting drops as it moves. Typically, a service station is mounted within the printer chassis to clean and protect the printhead. During operation, clogs in the printhead are periodically cleared by firing a number of drops of ink through each of the nozzles in a process known as "spitting." The waste ink is collected in a reservoir portion of the service station, which is often referred to as a "spittoon."

For storage, or during non-printing periods, the service stations usually include a capping system which humidically seals the printhead nozzles from contaminants and drying. Typically, the cap is an elastomeric enclosure having sealing lips which surround the nozzles and form an air-tight seal at the printhead face. Usually these caps include a venting feature that is used during capping to avoid forcing air into the nozzles, which would result in de-priming the nozzles. Some caps are also designed to facilitate priming, such as by being connected to a pumping unit that draws a vacuum on the printhead.

After spitting, uncapping, or occasionally during printing, most service stations have an elastomeric wiper that wipes the printhead surface to remove ink residue, as well as any paper dust or other debris that have collected on the printhead. These wipers were typically made of an elastomeric material, for instance a nitrile rubber, ethylene polypropylene diene monomer (EPDM) elastomer, or other types of rubber-like materials. The wiping action is usually achieved by either moving the printhead across the wiper, or moving the wiper across the printhead.

To improve the clarity and contrast of the printed image, recent research has focused on improving the ink itself. For example, to provide faster, more waterfast printing with darker blacks and more vivid colors, pigment based inks have been developed. These pigment based inks have a higher solid content than the earlier dye based inks. Both types of ink dry quickly, which allows inkjet printing mechanisms to use plain paper.

Unfortunately, the combination of small nozzles and quick drying ink leaves the printheads susceptible to clogging, not only from dried ink and minute dust particles or paper fibers, but also from the solids contained within the new pigment based inks. Ink residue also accumulates on the printhead face from excessive ink aerosol or over spray, particularly with the pigment based inks. After drying, this ink is difficult to remove, and if left on the pen face contributes to poor pen performance. For example, partially or totally blocked or occluded nozzles can lead to either missing or misdirected drops on the print media, either of which degrades the print quality.

Another characteristic of the new pigment based inks contributes to the nozzle clogging problem. The pigment based inks use a dispersant to keep the pigment particles from flocculating. Unfortunately, the dispersant tends to form a tough film on the printhead face as the ink vehicle evaporates. Besides the debris accumulated on the printhead face from ink over spray, paper crashes and servicing, this dispersant film also attracts paper dust and other contaminants. The dispersant film on the printhead face, as well as ink residue and debris surrounding the nozzles, is quite difficult to remove from the printhead.

With the earlier dye based inks, basically only the wiper blades were used to clean the printhead face. Unfortunately, the tough film formed by the pigment dispersant is not easily removed by these elastomeric wipers. Instead, this residue tended to ball up and roll, in a manner similar to the way that the adhesive known as rubber cement balls up when dried.

Several wet wiping systems have been proposed that wet the printhead then wipe it while still wet. One type of system spits ink then immediately wipes the ink from the printhead. Another system spits ink on the wiper then wipes the printhead with the wet wiper. Both of these ink-wiping systems used an EPDM elastomeric wiper. Another type of system applies a solvent to the printhead. In this system, the solvent is supplied through a saturated applicator to the printhead using a capillary or wicking action. The solvent is then wiped from the printhead using an EPDM elastomeric wiper. This solvent based wiping system unfortunately adds complexity and cost to the overall product.

Thus, a need exists for an improved inkjet printhead servicing system, which is directed toward overcoming, and not susceptible to, the above limitations and disadvantages.

SUMMARY OF THE INVENTION

According to one aspect of the present invention, a method is provided of servicing an ink jet printhead used in an inkjet printing mechanism. The method includes the step of capping the printhead through relative movement of the printhead and a cap until a capped position is reached where the printhead sealed against a wicking surface of the cap. When in the capped position, during a wicking step, ink is wicked through capillary action from the printhead onto the cap wicking surface, and in a dissolving step, any dried ink residue on the printhead is dissolved using the wicked ink.

According to a further aspect of the invention, a service station is provided for an ink jet printhead used in an inkjet printing mechanism. The service station includes a frame, and a cap supported by the flame to selectively seal the printhead in a capped position through relative movement of the printhead and cap. The cap has a wicking surface against which the printhead is sealed in the capped position. The wicking surface is of a material which extracts ink from the printhead through capillary action.

In an illustrated embodiment, the cap wicking surface material retains at least a portion of the extracted ink which is used to dissolve any dried ink residue on the printhead. The cap includes an elastomeric body defining a recessed portion that holds a mylar film insert to serve as the wicking surface. The cap wicking surface has a domed or convex surface that may be cleaned by a cap scraper.

According to another one aspect of the invention, an inkjet printing mechanism having such a wet capping service station is provided.

An overall goal of the present invention is to provide a servicing method and apparatus for an inkjet printing mechanism which contributes to the printing of sharp vivid images, graphics and text.

Another goal of the present invention is to provide an inkjet printing mechanism that has a simple and efficient printhead service station which enhances product quality.

BRIEF DESCRIPTION OF THE DRAWINGS

FIGS. 5 and 6 are side elevational views taken along lines 5—5 of FIG. 2, showing different stages of operation of the service station.

FIG. 7 is an enlarged side elevational view of a second embodiment of a service station with a wet capping system of the present invention.

DETAILED DESCRIPTION OF THE PREFERRED EMBODIMENT

Figure 1:
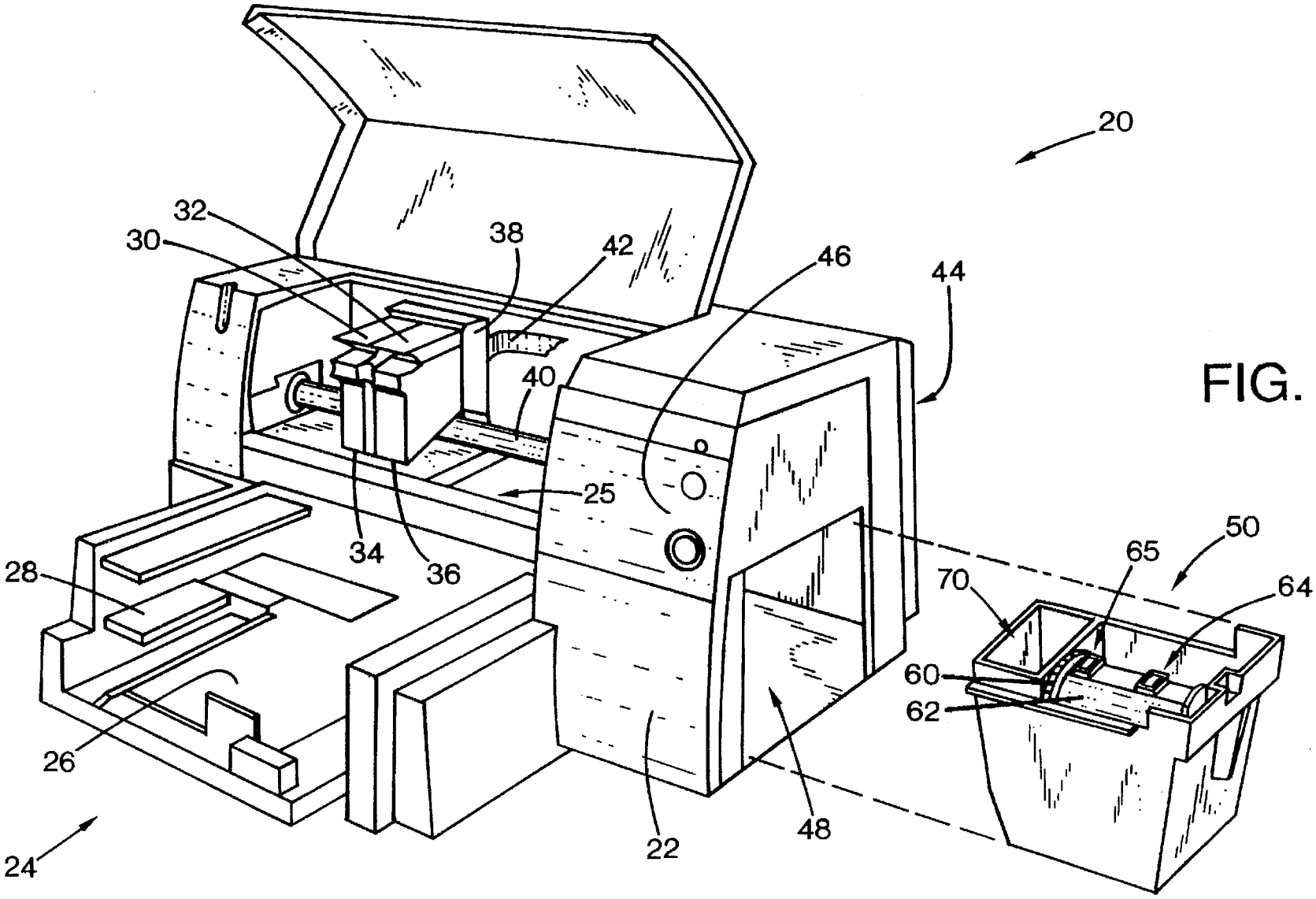
FIG. 1 is a perspective view of one form of an inkjet printing mechanism of the present invention, here, an inkjet printer, incorporating a first embodiment of a service station with a wet capping system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the inkjet printing mechanisms that may embody the present invention include plotters, portable printing units, copiers, cameras, and facsimile machines, to name a few, but for convenience the concepts of the present invention are illustrated in the environment of an inkjet printer 20.

While it is apparent that the printer components may vary from model to model, the typical inkjet printer 20 includes a chassis 22 and a print medium handling system 24 for supplying a print medium to the printer 20. The print medium may be any type of suitable sheet material, such as paper, card-stock, transparencies, mylar, foils, and the like, but for convenience, the illustrated embodiment is described using paper as the print medium. The print medium handling system 24 moves the print media into a print zone 25 from a feed tray 26 to an output tray 28, for instance using a series of conventional motor-driven rollers (not shown). In the print zone 25, the media sheets receive ink from an inkjet cartridge, such as a black ink cartridge 30 and/or a color ink cartridge 32. The illustrated color cartridge 32 is a tri-color pen, although in some embodiments, a group of discrete monochrome pens may be used, or a single monochrome black pen 30 may be used.

The illustrated cartridges 30, 32 each include reservoirs for storing a supply of ink therein, although other ink supply storage arrangements, such as those having reservoirs mounted along the housing (not shown) may also be used. The cartridges 30, 32 have printheads 34, 36 respectively. Each printhead 34, 36 has bottom surface comprising an orifice plate with a plurality of nozzles formed therethrough in a manner well known to those skilled in the art. The illustrated printheads 34, 36 are thermal inkier printheads, although other types of printheads may be used, such as piezoelectric printheads. The printheads 34, 36 typically include a plurality of resistors which are associated with the nozzles. Upon energizing a selected resistor, a bubble of ink is formed and then ejected from the nozzle and onto a sheet of paper in the print zone 25 under the nozzle.

The cartridges or pens 30, 32 are transported by a carriage 38 which may be driven along a guide rod 40 by a conventional drive belt/pulley and motor arrangement (not shown). The pens 30, 32 selectively deposit one or more ink droplets on a sheet of paper in accordance with instructions received via a conductor strip 42 from a printer controller, such as a microprocessor which may be located within chassis 22 at the area indicated generally by arrow 44. The controller typically receives instructions from a computer, such as a personal computer. The printhead carriage motor and the paper handling system drive motor operate in response to the printer controller, which operates in a manner well known to those skilled in the art. The printer controller may also operate in response to user inputs provided through a key pad 46. A monitor coupled to the computer may be used to display visual information to an operator, such as the printer status or a particular program being run on the computer. Personal computers, their input devices, such as a keyboard and/or a mouse device, and monitors are all well known to those skilled in the art.

First Embodiment

Figure 2:
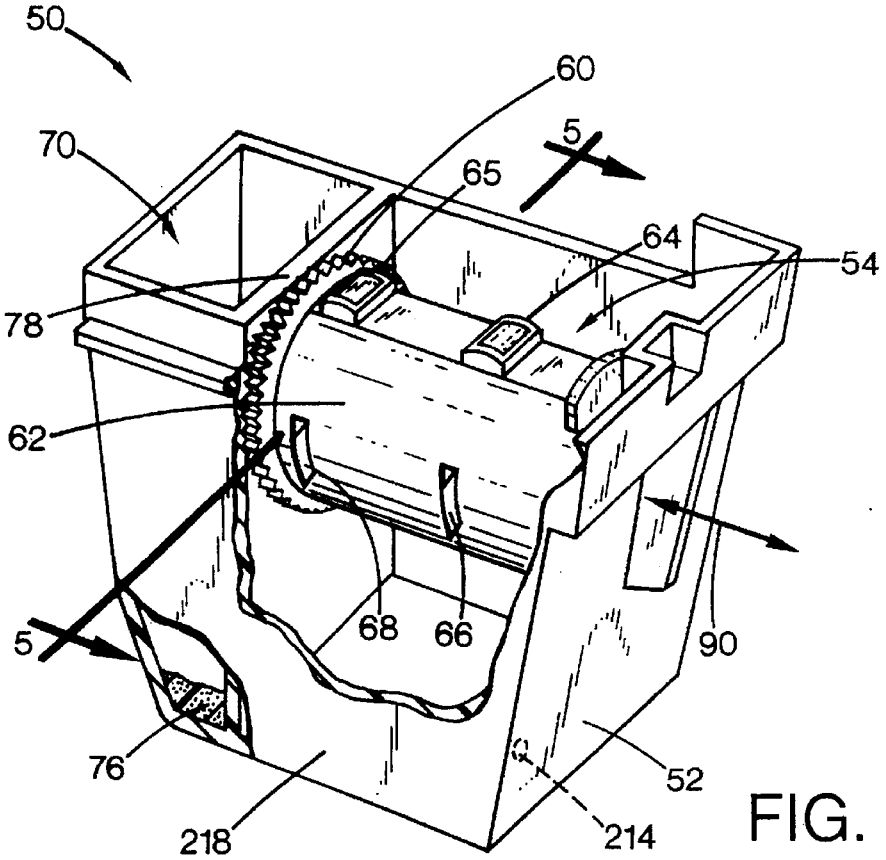
FIG. 2 is an enlarged fragmented perspective view of the service station of FIG. 1.

Located at one end of the travel path of carriage 38, the printer chassis 22 defines a chamber 48 that is configured to receive a service station 50, shown in greater detail in FIG. 2. Preferably, the service station 50 is constructed as a modular device capable of being unitarily inserted into the printer 20, to enhance ease of initial assembly, as well as maintenance and repair in the field. The illustrated service station 50 has a frame 52 that is slidably received within the chassis chamber 48. However, it is apparent that the service station 50 may also be constructed with the station frame 52 integrally formed within the chassis 22.

The service station 50 has a tumbler portion 54 mounted to frame 52 for rotation when driven by motor through an optional gear or belt assembly (not shown) that engages a drive gear 60. The tumbler 54 includes a main body 62 which supports an inkjet wet capping system, illustrated as comprising a color ink cap 64 and a black ink cap 65, constructed in accordance with the present invention. The main body 62 also supports color and black ink wipers 66 and 68 for wiping the respective black and color printheads 34, 36. Other functions may also be provided on the main body 62, such as primers and the like, which are known to those skilled in the art.

The service station 50 may also include an ink collecting chamber or "spittoon" portion 70 that receives ink that is selectively ejected or "spit" from the respective black and color pens 30, 32 when they are positioned above the spittoon. An absorbent liner material 76 may be placed near the bottom of the spittoon 70 to retain the spit ink while it is drying. Typical liquid absorbent materials may be of a felt, pressboard, sponge, or other comparable materials known to those skilled in the art. The spittoon 70 may be separated from the drive gear 60 by a wall member 78, which may also serve as a side wall for the spittoon chamber.

Figure 3:
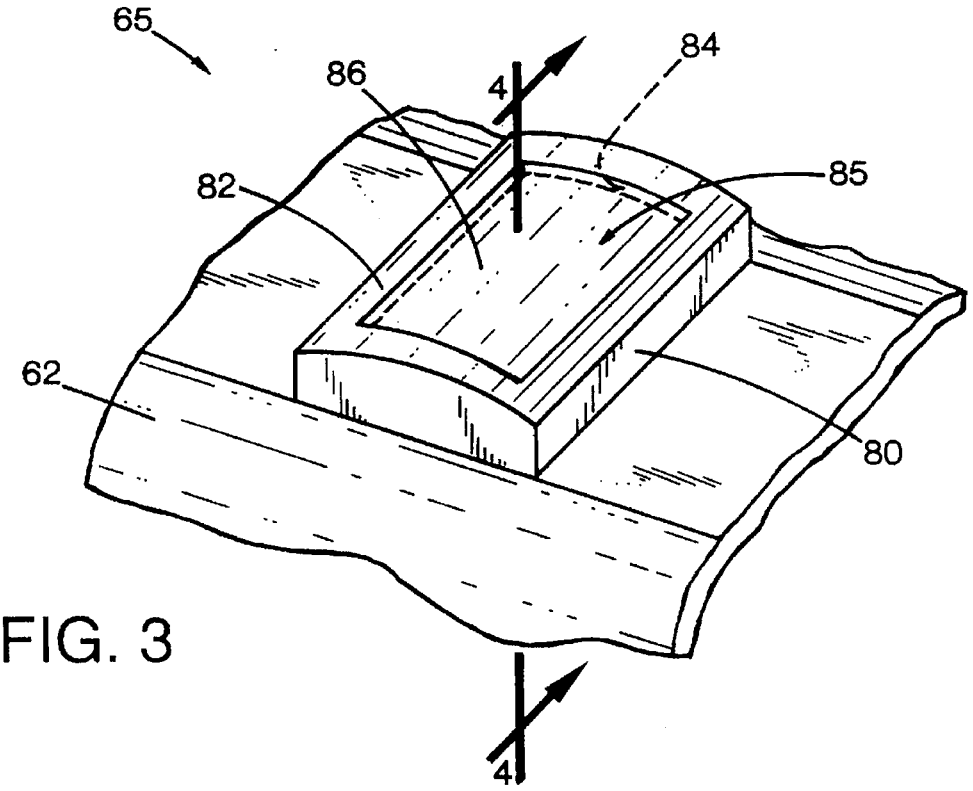
FIG. 3 is an enlarged perspective view of the wet capping system of FIG. 1.
Figure 4:
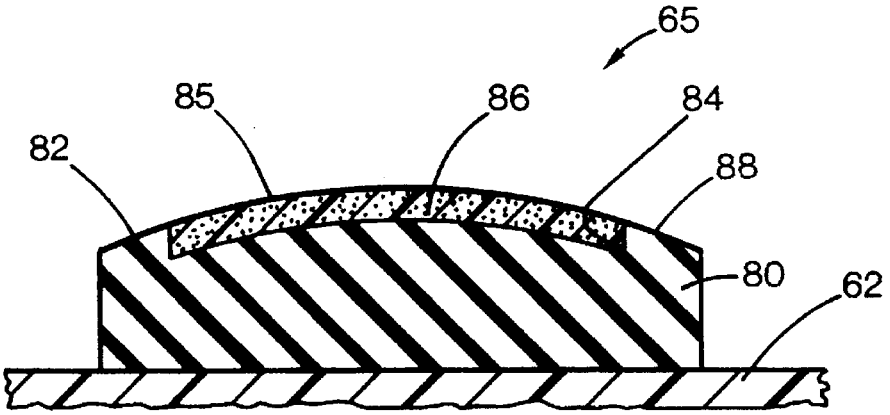
FIG. 4 is an enlarged side elevational view taken along lines 4—4 of FIG. 3.

FIGS. 3 and 4 show a preferred embodiment for capping the printhead of the black pen 30 as a wetting or wicking cap 65. The wicking cap 65 includes an elastomeric body 80 which may be made of a naturally occurring or synthetic, resilient, non-abrasive, elastomeric material, such as nitrile robber, silicone, a plastic, but more preferably, of an ethylene polypropylene diene monomer (EPDM) elastomer, or other comparable materials known in the art. The illustrated body 80 has a shape which preferably follows the pattern of the printhead nozzles, here, shown as being rectangular in shape to surround two or more linear arrays of nozzles. The cap body 80 may be mounted to the tumbler body 62 by adhesive means, or other bonding mechanisms known to those skilled in the art, such as oncert molding techniques, for instance.

The body 80 has a raised elastomeric sealing area or lip 82 that surrounds printhead nozzles, and provides a seal with the pen face to humidically seal the nozzles and minimize evaporation of the ink from the pen 30. Preferably, body 80 defines a recessed portion 84 which is surrounded by the sealing lip 82. The recessed portion 84 may be lined with an elastomer or a compliant thin film to form a wicking area or surface 85. Preferably, the wicking area 85 is lined with a compliant thin film wicking layer 86, such as a compliant high surface energy material or the like. For example, in the illustrated embodiment, the wicking area 85 is lined with a mylar film insert wicking layer 86, on the order of 0.05 mm thick.

Preferably, an upper surface 88 of the body 80 along the sealing lips 82, and the wicking surface 85 are contoured to define a domed or convex surface, preferably having an arched cross sectional shape, resembling a chordal planar cut through a cylinder. This convex domed curvature assists in minimizing the possibility of pressure spikes during the capping operation described further below. Pressure spikes may occur if the nozzles of the pen 30 are rapidly capped, forcing air bubbles into the nozzles, which can lead to depriming the pen.

Figure 5:
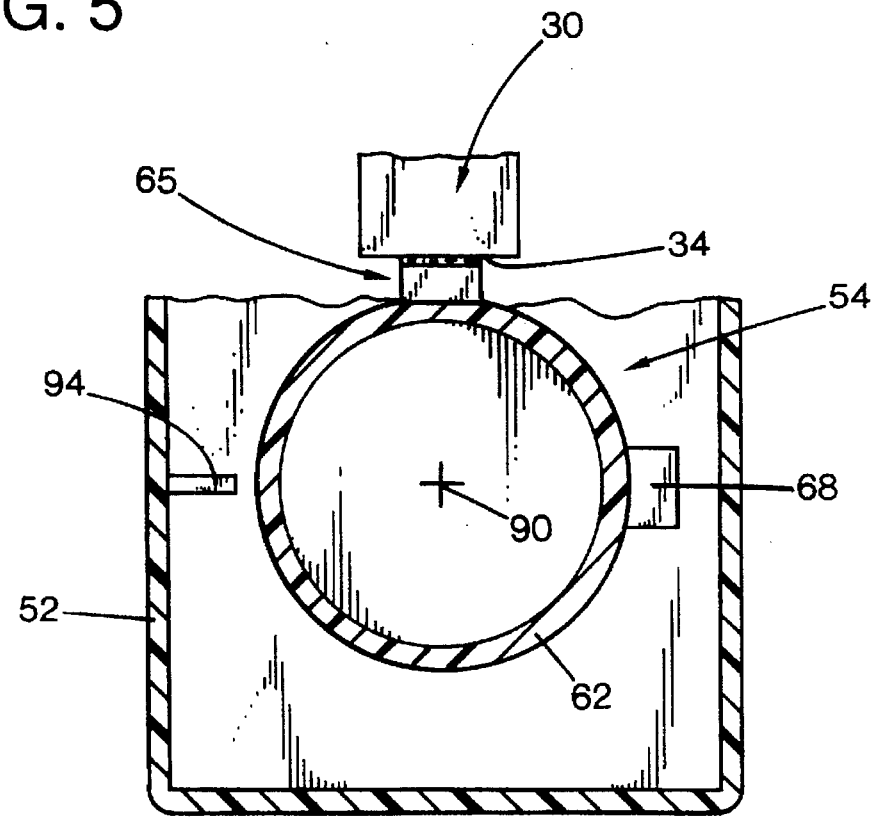

Referring to FIGS. 5 and 6, the operation of the wicking cap 65 is illustrated with respect to a tumbler mounting system. As shown in FIG. 5, the tumbler 62 has a longitudinal axis 90 about which it is rotated via the drive mechanism driving gear 60 until the wicking cap 65 is adjacent printhead 34. In this position, the thin film layer -86 assists in wicking, that is extracting ink via capillary action from pen 30. This wicked ink is then used to dissolve any dry ink solids that may have accumulated on the pen face during printing. Optionally, just before the printhead 30 engages the wicking cap 65, the printhead may be fired to eject ink onto the domed surface 85 of the cap. This pre-cap firing prewets the wicking surface 85, and ensures that ink will be wicked from the pen when it is resting on the cap. This prewetting step assists in initiating capillary action flow from the pen 30 and avoids depriming during capping.

To uncap, the pen 30 may be driven along the guide rod 40 to slidably disengage the seal of cap 65 against the printhead 34. The tumbler body 62 is then rotated via gear 60 in the direction indicated by arrow 92 (FIG. 6), until the wiper 68 is in position to wipe the printhead 34. Optionally, before wiping the pen 30 may first move to the spittoon portion 70 to spit ink, clearing any occlusions or blockages within the nozzles. In the wiping step shown in FIG. 6, the wiper 68 remains stationary while the printhead 30 is moved over the wiper in a direction parallel to the axis 90. Preferably, this wiping step is performed immediately after uncapping and/or after any optional spitting step, to clean the printhead 34 while it is still wet with ink, whether from wicking or spitting, and any redissolved ink.

Preferably, at the same time that the printhead 34 is being wiped, the upper domed surface 85 of the cap 65 is scraped. Scraping the cap surface 85 avoids drying of the wicked ink and any dissolved ink residue on surface 85 during print jobs. For example, the service station frame 52 may have a cap scraper 94 mounted thereto, which scrapes the cap 65, as shown in FIG. 6. The cap scraper 94 may be any type of conventional wiper, such as the illustrated blade-type wiper which may be constructed of the same materials as listed above for the cap body 80, but preferably is of an EPDM elastomer. To remove residue accumulated along the scraper 94 during previous cleaning cycles, the cap 65 may include an optional scraper cleaner fin 96 that removes the ink residue from scraper 94 before scraping the cap the wicking surface 85. The cleaner fin 96 may be of a plastic material and positioned to move the ink residue to an unobtrusive location, shown in FIG. 6 as removed ink residue 98 which eventually falls to the bottom of the service station frame 52.

In the illustrated embodiment, both the cap 65 and the printhead 34 are cleaned at substantially the same time, with cap 65 scraped through rotary action of the tumbler assembly 54, and printhead 34 wiped by moving with respect to wiper 68. Other timing arrangements for cleaning may also be employed, such as consecutively cleaning first the printhead then the cap, or visa versa, depending upon the location of the scraper 94 with respect to the placement of cap 65 and wiper 68 on tumbler body 62.

While the tumbler concept illustrated in FIGS. 1–4 is preferred because of its ease of implementation and adaptability for modular use, it is apparent that other arrangements may be used to index the pen capping, wiping, etc. functions rather than the tumbler 54. For example, gears or linkages (not shown) known to those skilled in the art may be used for selectively engaging the service station equipment 64, 65 and 66, 68 with the respective printheads 36, 34. For instance, suitable translating or floating sled types of service station operating mechanisms are shown in U.S. Pat. Nos. 4,853,717 and 5,155,497, both assigned to the present assignee, Hewlett-Packard Company.

Second Embodiment

FIG. 7 illustrates an alternate embodiment of a wet capping system 100 employing a floating sled type of service station. Here. the wet capping assembly 65 is mounted to a service station sled or platform 102, which selectively moves toward and away the printhead 34 for capping and uncapping, as indicated by arrow 104. The movement of sled 102 may be activated by a variety of different manners which are commercially available or known to those skilled in art. When the pen 30 is again ready to print, the capping assembly 65 is moved away from the printhead 34 by motion of the service station platform 102 to uncap the pen. After uncapping, the pen 30 then traverses in the direction indicated by arrow 106 toward a wiper 108 and/or spittoon (not shown), and then over the print zone 25. The wiper 108 removes wicked ink and any dissolved ink residue from the pen face as the pen traverses over the wiper. The printhead wiper 108 may be any type of conventional wiper, such as described above for wiper 68 and scraper 94, although one constructed of an EPDM elastomer is preferred. The wiper 108 may be stationarily mounted to the service station frame 52 or to the chassis frame 22. Alternatively, the wiper 108 may be mounted to move into engagement with the printhead 34 by being mounted to the sled 102, or in a rotary embodiment, to the tumbler body 62.

In operation, a method of servicing an inkier printhead used in an inkjet printing mechanism is illustrated using printer 20. It is apparent that while the capping system has been described above using the black pen 30 and cap 65, the color pan 32 and cap 64 may be similarly constructed and used. For simplicity, the method is illustrated herein with respect to only the black pen 30. The method includes the step of capping the printhead 34 through relative movement of the printhead 34 and cap 65 until a capped position (FIG. 5) is reached where the printhead sealed against wicking surface 85 of the cap. When in the capped position, during a wicking step, ink is wicked through capillary action from the printhead 34 onto the cap wicking surface 85. In a dissolving step, any dried ink residue on the printhead is dissolved using the wicked ink. With the cap being constructed preferably of a compressible material, and the wicking surface comprising a convex surface, the capping step comprises gradually contacting the printhead 34 with the convex wicking surface 85 to compress the cap body 82 when in the capped position.

In the embodiment of FIGS. 1–6, the relative movement of the capping step comprises rotating the cap into contact with the printhead until the capped position is reached. In the capping system 100 of FIG. 7, this relative motion is provided by translationally moving the cap into contact with the printhead 34.

After an uncapping step, the cap wicking surface 85 is cleaned to remove therefrom any dissolved ink residue, preferably by scraping the cap with a cap scraper. After uncapping, the printhead may be fired to eject ink and wet the pen face, after which the printhead may be wiped to remove any dissolved ink residue and wet ink. Preferably, the steps of wiping the printhead and scraping the cap are conducted substantially simultaneously. Prior to the capping step, the cap may be prewetted by firing the printhead to deposit ink on the wicking surface 85. Preferably, with the cap body 82 being of a compressible material, and the wicking surface 85 having a domed convex configuration, the capping step comprises gradually contacting the printhead with the convex wicking surface to compress the cap into the capped position.

Third Embodiment

Figure 8:
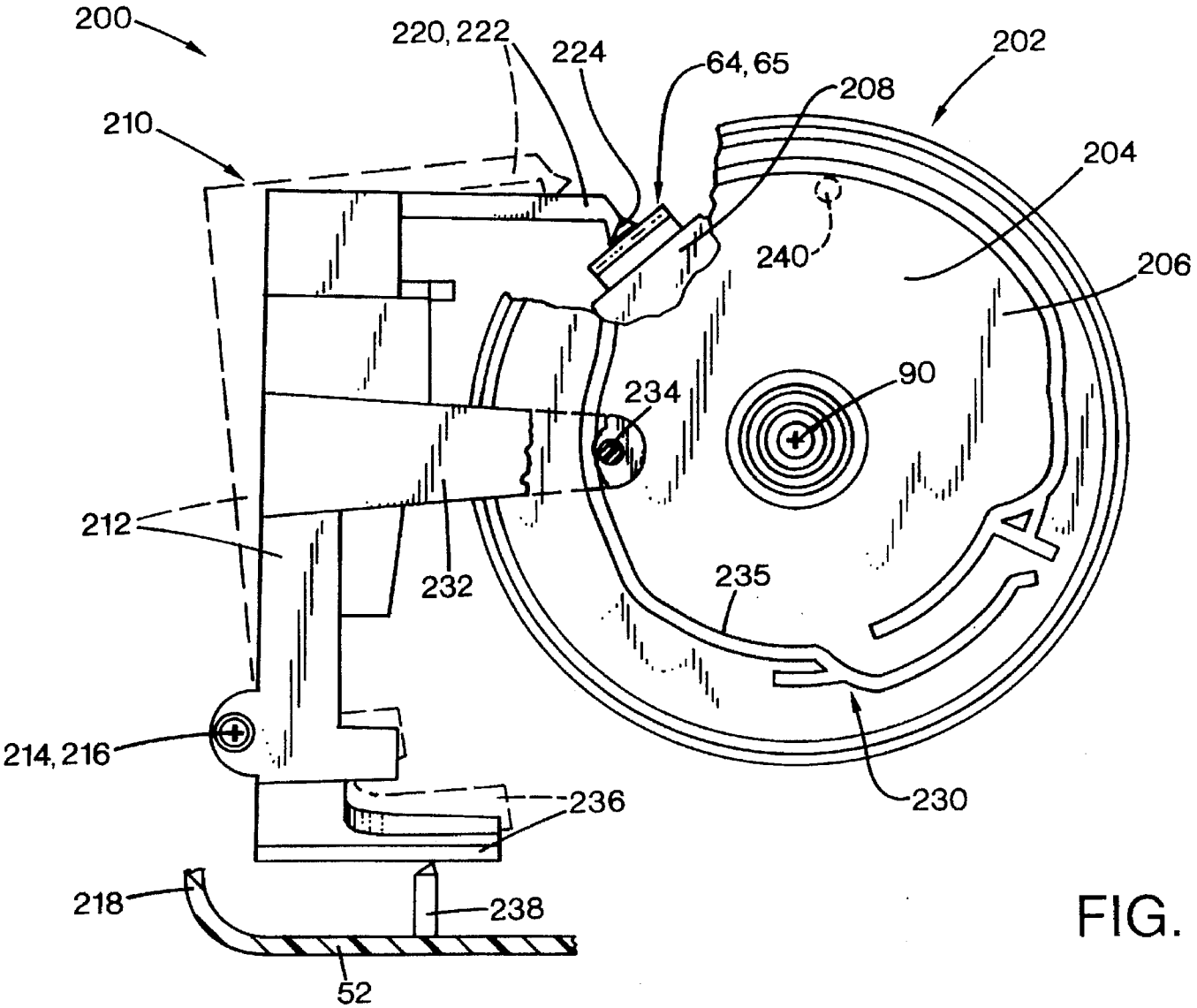
FIG. 8 is an enlarged side elevational view of a portion of a third embodiment of a rotary service station with a wet capping system of the present invention.

FIG. 8 shows an alternate embodiment of a rotary service station 200 constructed in accordance with the present invention that interactively scrapes ink residue from the wicking caps 64, 65. The service station 200 has an alternate tumbler assembly 202 with a body portion or tumbler 204 that is mounted in the service station frame 52 instead of the assembly 54 with tumbler 62 of FIGS. 1–6. The tumbler body 204 may have the drive gear 60 (not shown) at one end, and a tumbler wheel portion or rim 206 at the opposite end. The wicking caps 64, 65 may be mounted to a platform 208, which is captured by the tumbler 204, in the same manner as described above, such as by bonding with adhesives, sonic welding or other equivalent techniques. More preferably, the caps 64, 65 are mounted using oncert molding techniques known to those skilled in the art for molding elastomeric materials (cap body 80) to plastic materials (platform 208 of tumbler assembly 202).

The service station 200 has an optional cap cleaning or scraping system 210 that has a frame portion 212 which is preferably pivotally mounted within the service station frame 52, for example at two opposing pivot points 214, 216. FIG. 2 shows in dashed lines an approximate location where pivot 214 is mounted to frame 52, with a scrapper pivot axis defined by pivots 214, 216 being substantially parallel to a front wall 218 of the frame 52. Attached to the scraper frame 212 are two, substantially mutually parallel black and color scraper arms 220, 222 which each terminate in a scraper head 224. The scraper head 224 of scraper arms 220, 222 cleans the respective caps 64, 65 when the tumbler body 204 rotates the caps past the scraper heads 224. The width of each scraper head 224 is preferably sized to scrape the entire cap wicking surface 85 of each cap 64, 65, and the width of each arm 220, 222 is sized to rigidly support each head 224 during scraping.

Preferably, the tumbler body 204 rotates freely without interference of the scraping system 210 with various components mounted on the tumbler, such as the caps 64, 65. To facilitate this free travel, while still scraping the caps 64 and 65, the scraping system 210 includes a camming system 230, which controls the pivotal motion of the scraping system 210 with respect to the service station frame 52. The camming system 230 includes a cam arm 232 extending from the scraper frame 212. The cam arm 232 has a cam follower 234 that engages a cam surface 235 formed along the outer surface of the tumbler rim 206.

The position of the tumbler body 204 for scraping the caps 64, 65 with the heads 224 of scraper arms 220, 222 is shown in solid lines in FIG. 8, and a free travel or rest position of the scraping system 210 is shown in dashed lines. The scraper frame 212 includes a cantilever spring or biasing arm 236, which rides along a triangular end portion of a biasing post 238 extending upwardly from the bottom wall of the service station frame 52. The cantilever spring arm 236 pushes against the biasing post 238 to move the scraper heads 224 away from the tumbler 204. The spring arm 236 has resilient properties allowing it to compress slightly in response to the camming action provided by cam system 230 in response to rotation of the tumbler 204, so the scraper blades 224 are drawn into engagement with caps 64, 65, as shown in solid lines in FIG. 8.

After scraping ink residue from the caps 64, 65, the drive gear 60 rotates the tumbler 204 and the cam follower 234 travels along the cam surface 235 until eventually reaching a free travel or rest position of the scraper system 210, such as at position 204 shown in dashed lines. The spring force provided by the cantilever spring arm 236 pushing against the biasing post 238 moves the scraper frame 212 and heads 224 away from the tumbler body 204 by pivoting around pivots 214, 216. In the rest position, the tumbler 204 and any other components mounted thereon may travel freely past the scrapers. Of course, the cam surface 235 may be configured to draw the scraper into engagement with other tumbler components to provide component cleaning and/or conditioning, such as shown on the lower right portion of the rim 206 in FIG. 8.

Fourth Embodiment

Figure 9:
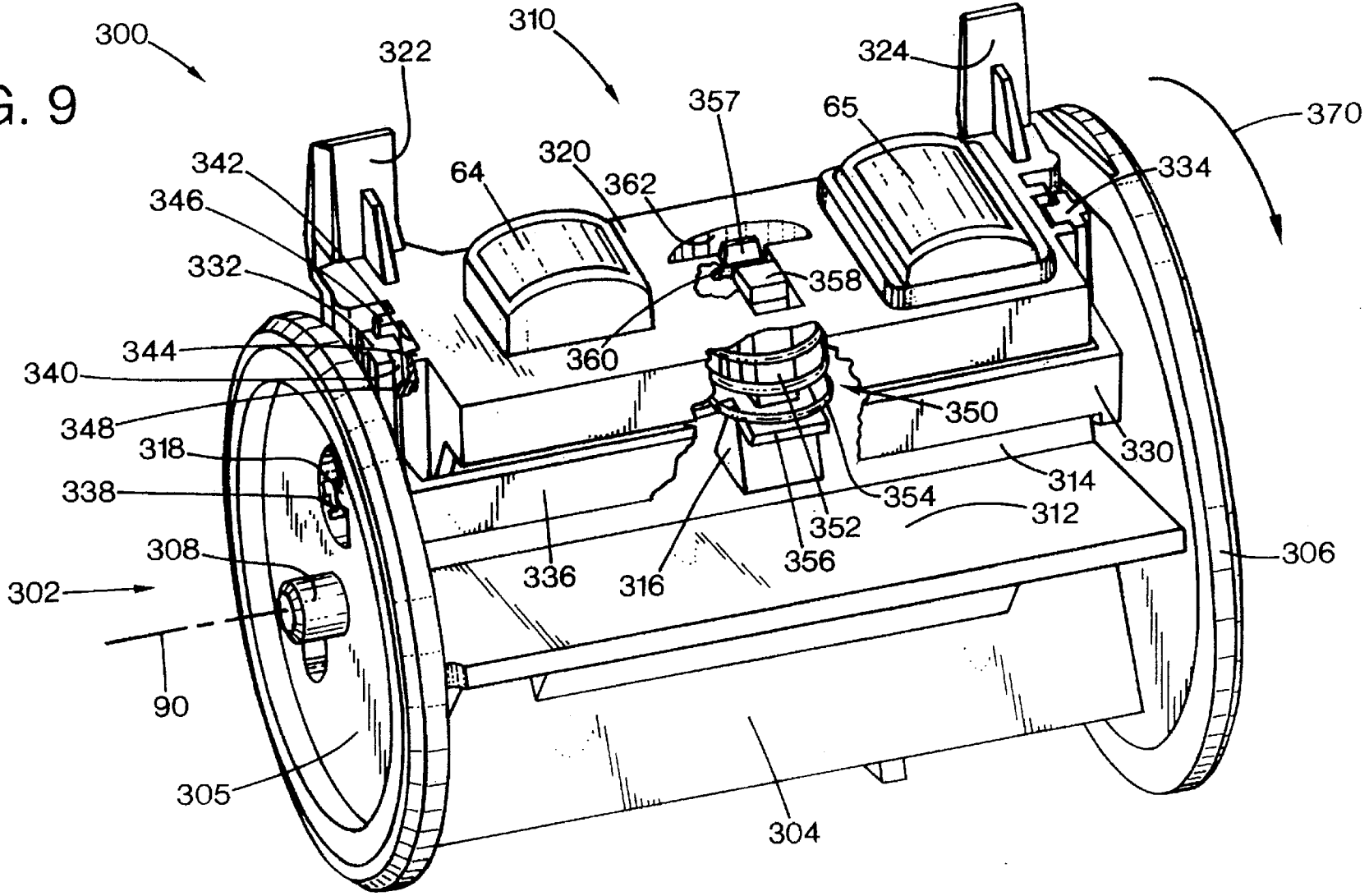
FIG. 9 is an enlarged perspective view of a portion of a fourth embodiment of a rotary service station with a wet capping system of the present invention.

FIG. 9 shows an alternate embodiment of a rotary service station 300 constructed in accordance with the present invention that has an alternate tumbler assembly 302 which may be mounted in the service station frame 52 instead of the assembly 54 shown in FIGS. 1–6. The tumbler assembly 302 has a body portion or tumbler 304 including two opposing wheel portions or rims 305, 306, which are pivotally mounted to the service station at hubs, such as hub 308 on rim 305. The drive gear 60, omitted for simplicity from FIG. 9, may be formed around the periphery of rim 305. The service station 300 may also include the cap scraper 94 (FIGS. 5 and 6), or the optional cap scraping system 210 of FIG. 8, with rim 306 having the cam surface 235 formed thereon.

The rotary service station 300 has a printhead wet capping system 310, constructed in accordance with the present invention, which includes the tumbler body 304. The tumbler body 304 has a rest wall 312, and a stop wall 314, each extending between the two rims 305, 306 and joining together near the longitudinal axis 90. A rocker pivot post 316 extends upwardly from the stop wall 314. The tumbler rims 305 and 306 each have opposing half-moon shaped recesses which each define yoke pivot posts, such as post 318 of rim 305.

The capping system 310 also includes a cap support platform or sled 320. The color and black wicking caps 64, 65 may be mounted to sled 320, such as by bonding with adhesives, sonic welding or other equivalent, techniques. More preferably, the caps 64, 65 are mounted to sled 320 using oncert molding techniques known to those skilled in the art for molding elastomeric materials (cap body 80) to plastic materials (sled 320). While a single color ink wicking pad 64 is shown for the tri-color pen 32, a conventional non-wicking cap (not shown) may be preferred for tri-color pens; however, for three separate color pens (cyan, magenta and yellow pens, for instance) three separate wicking caps 64 located side-by-side (not shown) on sled 320 may be preferred. The sled 320 also includes two carriage alignment arms 322 and 324, which engage a downwardly extending alignment member 326 (see FIGS. 10 and 11) of the printhead carriage 38 to facilitate capping, as described further below.

The sled 320 is coupled to the tumbler body 304 by a link or yoke member 330. The yoke 330 is a dual pivot structure, having two ear members 332 and 334 joined together by a bridge member 336. Each ear 332, 334 has a lower rim pivot member which extends through the half-moon shaped slots in the tumbler rims 305, 306, such as the rim pivot member 338 which pivots around post 318 in rim 305. The operational pivoting of yoke 330 with respect to tumbler body 304 is shown schematically in FIGS. 10 and 11, in the rest state prior to capping (FIG. 10) and when capped (FIG. 11), whereas FIG. 9 shows the capped position.

The sled 320 is pivoted to the yoke 330 by two upper pivot members 340 located along each inner surface of ears 332, 334. The sled has a pair of pivot pockets 342 defined by rails 344, 346 and a lower member 348 located along each side of sled 320 adjacent yoke ears 332, 334. Each of the upper pivot members 340 pivot within their respective associated pockets 342, such as shown adjacent yoke ear 332 in FIG. 9, and as shown schematically in FIGS. 10 and 11. Each pivot member 340 controls the pivoting of the sled 320 with respect to yoke 330 as the yoke 330 toggles between the rest and fully capped positions of FIGS. 10 and 11, respectively.

To bias the sled 320 in a rest position relative to the tumbler body 304, the capping assembly 310 also includes a biasing member 350 which urges sled 320 away from the tumbler body 304. To accomplish this, the biasing member 350 includes a rocking spring retainer or keeper member 352 (omitted for simplicity from FIGS. 10 and 11), and a compression coil spring 354. The retainer 352 has a rocker member 356 that rests upon the rocker pivot post 316, which projects from the tumbler stop wall 314. The keeper 352 includes two projecting finger members 357, 358 which each terminate in latches that grasp a pivot pin or past member 360 of the sled 320. The sled pivot post 360 is recessed within a roughly T-shaped slot 362 formed within the cap-supporting platform of sled 320. The T-shaped slot 362 is sized to slidably receive therethrough the tips of the retainer fingers 357, 358. Preferably, the spring 354 is under a slight compression to bias sled 320 away from the tumbler stop wall 314, and toward a rest position adjacent the rest wall 312. The spring 354 is secured to the sled 320, such as during assembly and disassembly, by the legs of the rocker member 356 of the spring retainer 352.

Moreover, the retainer fingers 357, 358 cooperate with the sled slot 362 to allow the sled 320 to further compress spring 354 through downward force of the printheads 30, 32 to securely cap and seal the printhead nozzle plates 34, 36. That is, while the upper portions of the retainer fingers 357, 358 are shown as being nearly flush with the upper surface of sled 320 in FIG. 9, the upper surfaces of the fingers 357, 358 may extend above this upper surface as the spring 354 is compressed during capping. As shown schematically in FIG. 11, compression of the spring 354 causes the pivot members 340 to float upwardly in the sled pockets 342 between rails 344, 346, which allows the sled 320 to move with respect to the yoke 330. Note, the relatively loose fit of pivots 340 in pockets 342 advantageously allows some tilting of sled 320 with respect to yoke 330, for instance if pivots 340 travel unequal distances (horizontally and/or vertically) in pockets 342.

Figure 10:
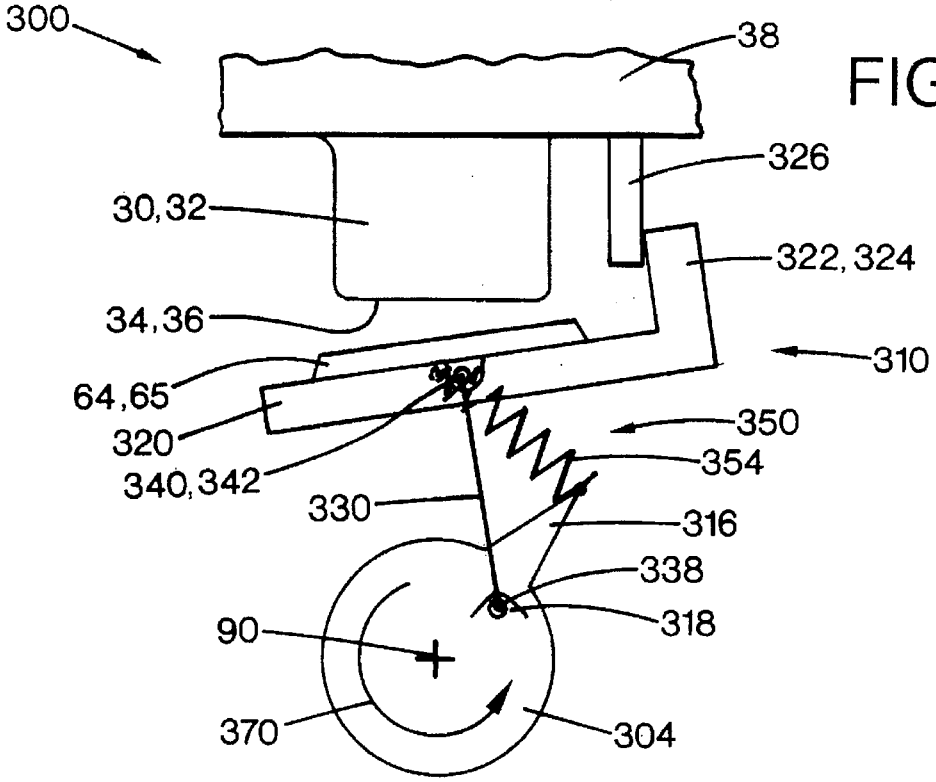
FIGS. 10 and 11 are schematic side elevational views illustrating the capping operation of the rotary service station embodiment of FIG. 9.
Figure 11:
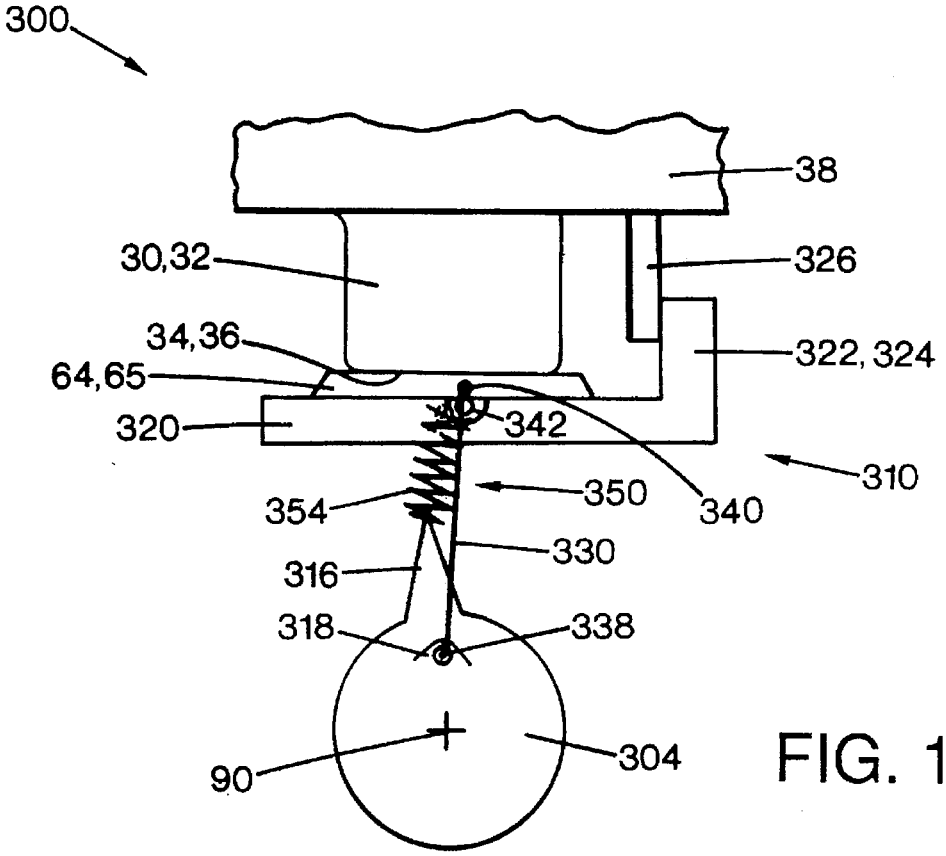

In operation, the printer 20 includes a conventional DC stepper motor, which is coupled to drive the service station about axis 90, via the drive gear 60 (the teeth of drive gear 60 may be formed around the periphery of tumbler rim 305, as illustrated for the first embodiment of FIGS. 1–4). With reference to FIGS. 9 and 10, the tumbler body 304 is rotated in the direction indicated by the curved arrow 370 until the carriage engagement arms 322, 324 contact the carriage alignment member 326. Continued rotation of the tumbler body 304 in the direction of arrow 370 causes the capping assembly 310 to pivot into a capped position, shown in FIG. 11, to cap and seal the printheads 30 and 32. FIGS. 10 and 11 illustrate the rotation of the yoke 330 with respect to the tumbler body 304, and the rotation of sled 320 with respect to yoke 330 and tumbler body 304.

As shown in FIG. 11, when the respective black and color pens 30, 32 are capped, the spring 354 is compressed. The compression force supplied by spring 354 upwardly from the tumbler stop wall 314 forces the sled 320 and caps 64, 65 to press against the pen faces 34, 36. The gimbal mounting provided by the loose fit of the yoke pivots 340 within sled pockets 348, in combination with the gimbaling action provided by the mounting of the sled 320 to the retainer 352 and rocker member 356 on post 316, allows the sled 320 to tilt with respect to the longitudinal axis 90. This tilting or gimbaling action provides a pressure-tight seal adjacent the pen nozzles while compensating for irregularities on the printhead faces 34, 36, such as ink build-up.

In the capping position shown in FIGS. 9 and 11, the spring force supplied by spring 354 maintains a controlled pressure against the pen faces 34, 36, even when the printer unit 20 has been turned off. Positive energy provided by the stepper motor reversing the direction of arrow 370 is required to disengage the capping assembly 310 from the pens 30, 32. The keeper 352 has a non-centering feature which forces the sled 320 against the rest wall 312 when arms 322, 324 are not contacted by the printhead carriage member 326. Thus, this off-centering feature forces the cap sled 320 into a rest position adjacent wall 312, allowing the capping assembly 310 to be rotated in the direction opposite arrow 370 without contacting the printhead, which may be desirable to facilitate other printhead servicing operations, such as wiping or priming.

Conclusion

A variety of advantages are realized using the wet capping system illustrated herein with respect to cap assembly 65.

For example, the wicking cap 65 advantageously uses the ink from the pen 30 to act as a solvent to remove dried ink from the printhead face. Thus, no harsh solvents are required which could degrade the pen face. Also, cumbersome solvent dispensing systems are not needed. Another advantage of using a mylar film insert wicking layer 86 is that the mylar material has been found to be particularly resilient and resistant to being tom during use, for instance, by the scraper 224 in system 200 of FIG. 8. As a further advantage, the cap assembly 65 is lightweight, simple, efficient, and relatively easy to manufacture and assemble. Additionally, the wicking cap 65 is constructed using a simple geometry with readily available materials, which contributes to providing a more economical and reliable printing mechanism, such as printer 20.

We claim:

1. A method of servicing an inkjet printhead used in an inkjet printing mechanism, comprising the steps of:

capping the printhead through relative movement of the printhead and a cap until a capped position is reached where the printhead is sealed against a wicking surface of the cap, wherein the cap is of a compressible material, and the wicking surface comprises a convex surface, and the capping step further comprises gradually contacting the printhead with the convex wicking surface to compress the cap in the capped position;

in the capped position, wicking ink through capillary action from the printhead onto the cap wicking surface; and in the capped position, dissolving any dried ink residue on the printhead using the wicked ink.

2. A method according to claim 1, wherein the relative movement of the capping step comprises rotating the cap into contact with the printhead until the capped position is reached.

3. A method according to claim 2, further comprising the steps of:

uncapping the printhead after the dissolving step; and after uncapping, cleaning the wicking surface of the cap to remove therefrom any dissolved ink residue, and wherein the cleaning step comprises the steps of:

rotating the cap from a capping position toward a scraping position;

pivoting a scraper into a scraping position in response to the step of rotating the cap; and with the cap and scraper in the scraping position, scraping any ink residue from the cap with the scraper by rotating the cap past the scraper.

4. A method according to claim 1, further comprising the step of, prior to the capping step, prewetting the cap by firing the printhead to deposit ink on the wicking surface.

5. A method according to claim 1, further comprising the steps of:

uncapping the printhead after the dissolving step; and after uncapping, cleaning the wicking surface of the cap to remove therefrom any dissolved ink residue.

6. A method according to claim 5, wherein the cleaning step comprises scraping the cap with a cap scraper.

7. A method according to claim 1, wherein the convex wicking surface comprises a surface defined as a chordal planar cut through a cylinder.

8. A method of servicing an inkjet printhead used in an inkjet printing mechanism, comprising the steps of:

capping the printhead through relative movement of the printhead and a cap until a capped position is reached where the printhead is sealed against a wicking surface of the cap, wherein the wicking surface comprises a domed surface, and wherein the relative movement of the capping step comprises translationally moving the printhead over the domed wicking surface of the cap into the capped position;

in the capped position, wicking ink through capillary action from the printhead onto the cap wicking surface; and in the capped position, dissolving any dried ink residue on the printhead using the wicked ink.

9. A method according to claim 8, further comprising the steps of:

uncapping the printhead after the dissolving step; and after uncapping, cleaning the wicking surface of the cap to remove therefrom any dissolved ink residue.

10. A method according to claim 9, wherein the cleaning step comprises scraping the cap with a cap scraper.

11. A method according to claim 8, wherein the domed wicking surface comprises a surface defined as a chordal planar cut through a cylinder.

12. A method of servicing an inkjet printhead used in an inkjet printing mechanism, comprising the steps of:

capping the printhead through relative movement of the printhead and a cap until a capped position is reached where the printhead is sealed against a wicking surface of the cap;

in the capped position, wicking ink through capillary action from the printhead onto the cap wicking surface;

in the capped position, dissolving any dried ink residue on the printhead using the wicked ink;

uncapping the printhead after the dissolving step;

firing the uncapped printhead to eject ink and wet the printhead; and after the firing step, wiping the printhead to remove therefrom any dissolved ink residue and wet ink.

13. A method according to claim 12, further comprising the step of after uncapping, scraping the cap with a cap scraper.

14. A method according to claim 13, wherein the steps of wiping the printhead and scraping the cap are conducted substantially simultaneously.

15. A method of servicing an inkjet printhead used in an inkjet printing mechanism, comprising the steps of:

capping the printhead through relative movement of the printhead and a cap until a capped position is reached where the printhead is sealed against a wicking surface of the cap;

in the capped position, wicking ink through capillary action from the printhead onto the cap wicking surface;

in the capped position, dissolving any dried ink residue on the printhead using the wicked ink;

wherein the cap is of a compressible material, and the wicking surface comprises a convex surface;

wherein the capping step comprises gradually contacting the printhead with the convex wicking surface to compress the cap in the capped position;

prior to the capping step, prewetting the cap by firing the printhead to deposit ink on the wicking surface;

after the dissolving step, uncapping the printhead;

firing the uncapped printhead to eject ink and wet the printhead;

after the firing step, wiping the printhead to remove therefrom any dissolved ink residue and wet ink; and substantially simultaneously with the step of wiping the printhead, scraping the cap with a cap scraper.

16. A method according to claim 15, wherein the relative movement of the capping step comprises rotating the cap into contact with the printhead until the capped position is reached.

17. A method according to claim 15, wherein the relative movement of the capping step comprises translationally moving the printhead over the convex wicking surface of the cap into the capped position.

18. A method according to claim 15, wherein the convex wicking surface comprises a surface defined as a chordal planar cut through a cylinder.

19. A service station for servicing an inkjet printhead used in an inkjet printing mechanism, comprising:

a frame; and a cap supported by the frame to selectively seal the printhead in a capped position through relative movement of the printhead and cap, the cap having a wicking surface against which the printhead is sealed in the capped position, with the wicking surface of a material which extracts ink from the printhead through capillary action, and wherein the cap wicking surface comprises a convex surface.

20. A service station according to claim 19 wherein the cap wicking surface is also of a material that retains at least a portion of the extracted ink to dissolve any dried ink residue on the printhead using the extracted ink.

21. A service station according to claim 19 wherein the cap comprises an elastomeric body defining a recessed portion, and an insert secured within the body recessed portion, with the insert having an exposed surface comprising the wicking surface.

22. A service station according to claim 21 wherein the insert comprises a mylar film material.

23. A service station according to claim 19 wherein:

the cap is supported by the frame for rotational movement of the cap relative to the frame to selectively seal the printhead;

the service station further includes a scraper pivotally mounted to the frame; and a camming system coupling the cap and scraper to engage and scrape ink residue from the cap in response to rotation of the cap.

24. A service station according to claim 19 wherein the convex wicking surface of the cap comprises a surface defined as a chordal planar cut through a cylinder.

25. An inkjet printing mechanism, comprising:

a chassis;

a printhead mounted to the chassis for reciprocal movement across a print zone and a service station chamber portion of the chassis; and a service station within the service station chamber that selectively services the printhead, the service station including a frame supported by the chassis, and a cap supported by the frame to selectively seal the printhead in a capped position through relative movement of the printhead and cap, the cap having a wicking surface against which the printhead is sealed in the capped position, with the wicking surface of a material which extracts ink from the printhead through capillary action, and wherein the cap wicking surface comprises a convex surface.

26. An inkjet printing mechanism according to claim 25 wherein:

the service station further includes a printhead wiper that selectively wipes the printhead, and a cap scraper that selectively scrapes the cap;

the frame comprises a stationary frame member and a rotary frame member; and the cap scraper and printhead wiper are supported by the rotary frame member, and the cap scraper is supported by the stationary frame member, with the printhead wiper and the cap scraper being supported to clean the respective printhead and cap at substantially the same time.

27. An inkjet printing mechanism according to claim 25 wherein:

the cap is supported by the frame for rotational movement of the cap relative to the frame to selectively seal the printhead;

the service station further includes a scraper pivotally mounted to the frame; and a camming system coupling the cap and scraper to engage and scrape ink residue from the cap in response to rotation of the cap.

28. An inkjet printing mechanism according to claim 25 wherein the convex wicking surface of the cap comprises a surface defined as a chordal planar cut through a cylinder.

* * * * *